US007762169B2

(12) United States Patent
Kaposi

(10) Patent No.: US 7,762,169 B2
(45) **Date of Patent: *Jul. 27, 2010**

(54) FOOD CHOPPER

(75) Inventor: Sascha Kaposi, Tacoma, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/670,255

(22) Filed: Feb. 1, 2007

(65) Prior Publication Data

US 2007/0125210 A1 Jun. 7, 2007

Related U.S. Application Data

(63) Continuation of application No. 11/033,944, filed on Jan. 11, 2005, now Pat. No. 7,191,691.

(60) Provisional application No. 60/623,582, filed on Oct. 29, 2004.

(51) Int. Cl.
*B26D 1/03* (2006.01)
*B26D 1/00* (2006.01)

(52) U.S. Cl. ..... 83/167; 83/522.11; 83/564; 83/856; 83/932; 30/124; 30/299

(58) Field of Classification Search ..... 30/299, 30/124; D22/134; 220/523, 527, 575, 579, 220/625; 241/84.3; 99/467, 646 C; 83/167, 83/522.11, 564, 597, 599, 466.1, 651.1, 856–858; 215/DIG. 8; 73/1.73, 1.74, 426, 427–429; 229/117.13, 117.14, 117.15; D8/DIG. 1; 294/144, 172

See application file for complete search history.

(56) References Cited

U.S. PATENT DOCUMENTS

| | | | | |
|---|---|---|---|---|
| 662,588 | A | 11/1900 | Bloom | |
| 751,433 | A | 2/1904 | Kennedy of al. | |
| 809,952 | A | 1/1906 | Hoffa | |
| 928,019 | A | 7/1909 | Bartow | |
| 1,504,501 | A | 8/1924 | Pope | |
| 1,674,475 | A * | 6/1928 | Loomis | 99/508 |
| 2,030,975 | A | 2/1936 | Fairchild | |
| 2,245,978 | A * | 6/1941 | Hyland | 83/553 |
| 2,309,814 | A | 2/1943 | Youngberg | |
| 2,485,877 | A | 10/1949 | Hamilton, Jr. | |
| 2,645,262 | A * | 7/1953 | Marasco | 83/435.15 |
| 2,735,467 | A * | 2/1956 | Hellmich | 241/84.3 |
| 2,788,820 | A * | 4/1957 | Hellmich | 83/697 |
| 3,077,213 | A | 2/1963 | Germano | |

(Continued)

FOREIGN PATENT DOCUMENTS

| | | |
|---|---|---|
| GB | 2286110 | 8/1995 |

(Continued)

*Primary Examiner*—Boyer D. Ashley
*Assistant Examiner*—Edward Landrum
(74) *Attorney, Agent, or Firm*—Black Lowe & Graham, PLLC

(57) ABSTRACT

A food chopping or slicing device preferably includes three primary components, including a lid, a blade tray, and a food reservoir. The lid and the food reservoir are pivotally connected to one another, with the blade tray being removably mounted within an upper rim of the reservoir. In some embodiments a reservoir bottom is removable and the device includes orthogonal volumetric markings.

11 Claims, 3 Drawing Sheets

U.S. PATENT DOCUMENTS

| | | | | | |
|---|---|---|---|---|---|
| 3,997,072 | A | | 12/1976 | Guth | |
| 4,095,339 | A | | 6/1978 | Turner | |
| 4,212,431 | A | | 7/1980 | Doyel | |
| 4,292,846 | A | * | 10/1981 | Barnett | 73/427 |
| 4,457,070 | A | | 7/1984 | Reeves | |
| 4,557,053 | A | | 12/1985 | Hadley, Jr. | |
| 4,574,479 | A | | 3/1986 | Gramann | |
| 4,670,987 | A | | 6/1987 | Casey, Jr. | |
| 4,733,589 | A | * | 3/1988 | Wolff | 83/858 |
| 4,759,148 | A | * | 7/1988 | Love | 43/54.1 |
| 4,805,843 | A | | 2/1989 | Draper | |
| 4,924,575 | A | | 5/1990 | James | |
| D331,687 | S | | 12/1992 | Pujol Gilbert | |
| 5,249,693 | A | * | 10/1993 | Gillispie et al. | 220/263 |
| 5,303,472 | A | | 4/1994 | Mbanugo | |
| 5,337,480 | A | * | 8/1994 | Codikow | 30/114 |
| 5,499,578 | A | | 3/1996 | Payne | |
| 5,516,038 | A | | 5/1996 | Zaccarini | |
| 5,692,424 | A | * | 12/1997 | Wallace | 83/167 |
| 5,937,525 | A | | 8/1999 | Chan | |
| 5,967,875 | A | | 10/1999 | Graef | |
| D447,391 | S | | 9/2001 | Bodum | |
| 6,293,445 | B1 | * | 9/2001 | Miller | 224/240 |
| 6,558,244 | B1 | | 5/2003 | Nedelka | |
| D485,328 | S | * | 1/2004 | Jastrzembski | D22/134 |
| 6,802,149 | B1 | * | 10/2004 | Albanese et al. | 43/4 |
| 6,805,032 | B2 | | 10/2004 | Engdahl | |
| D499,615 | S | | 12/2004 | Nordgren | |
| D519,001 | S | | 4/2006 | So | |
| 7,191,691 | B2 | | 3/2007 | Kaposi | |
| 2002/0003144 | A1 | | 1/2002 | Grimes | |
| 2003/0051345 | A1 | | 3/2003 | Yeung Louie et al. | |
| 2004/0055437 | A1 | * | 3/2004 | Engdahl | 83/597 |

FOREIGN PATENT DOCUMENTS

| | | |
|---|---|---|
| WO | 02064331 | 8/2002 |
| WO | 2005090029 | 9/2005 |

* cited by examiner

FIG.1
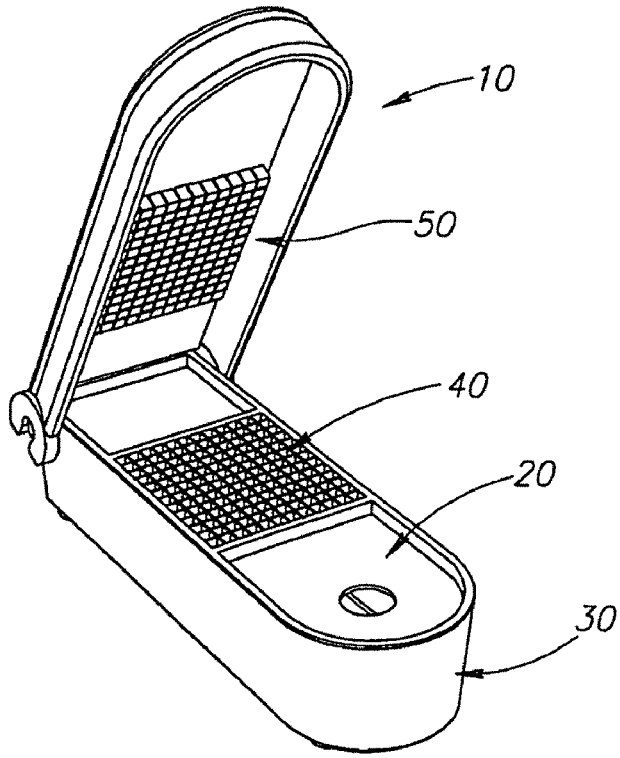
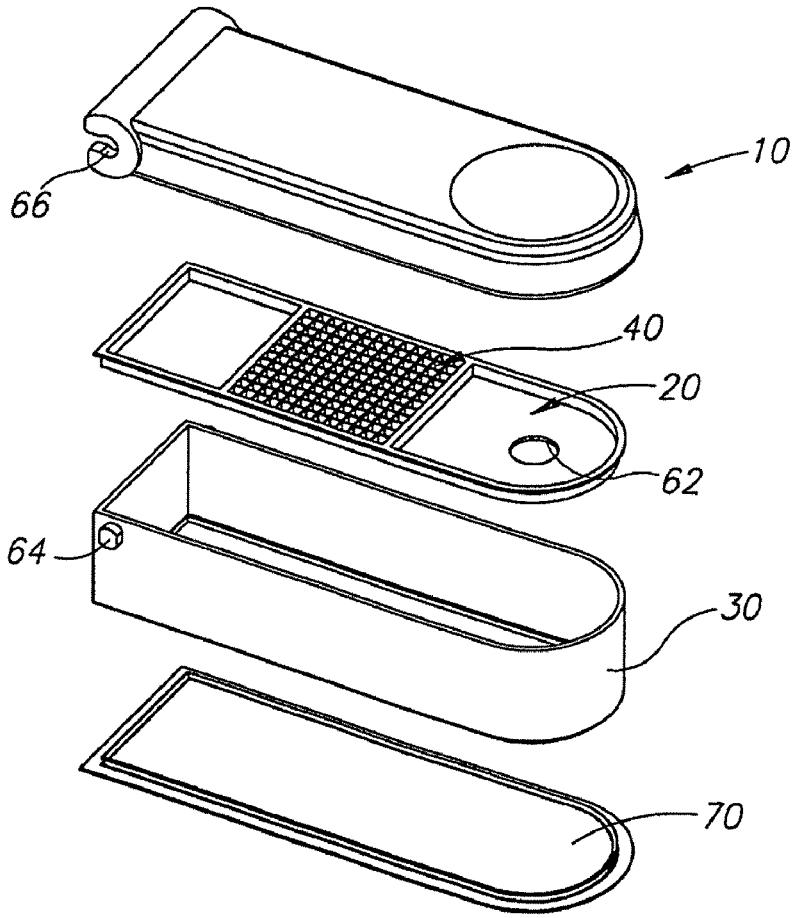
FIG.2

FOOD CHOPPER

PRIORITY CLAIM

This application claims the benefit of prior U.S. utility application Ser. No. 11/033,944, filed on Jan. 11, 2005, which claims the benefit of Provisional application Ser. No. 60/623,582, filed Oct. 29, 2004. Each of these applications is incorporated by reference.

FIELD OF THE INVENTION

This invention relates generally to food preparation devices, including devices for chopping or slicing onions, mushrooms, and the like.

BACKGROUND OF THE INVENTION

In preparing food, it is often desirable to prepare onions by slicing them in strips or chopping them into small pieces. Most commonly, this is done by using a knife. There are other specially-designed devices for chopping foods, but none are particularly well suited to chopping onions.

One exemplary food cutting device is used to cut potatoes for French fries, incorporating a sliding array of rectangular projections that can be pressed downward to push the potato through a grid of blades. This arrangement is common to all French fry cutters, which can also be used to cut other vegetables such as onions. In such devices, the blades and the projections are parallel to each other at all times. One problem with such devices is that there is no integrated reservoir to receive the sliced potatoes as they are pushed through the grid of blades.

There are also presently existing mushroom cutters, including a blade frame and pusher element that are pivotally connected to each other via an elongated handle. Unfortunately, the operation of the device pushes the food onto the countertop or work surface, limiting the amount of food that can be chopped and potentially mashing the food or resulting in an uneven slicing operation. Alternatively the user must hold the device above the countertop with one hand, and use the other hand to receive the slices as they emerge from the device.

There is therefore a need for an improved food chopping or slicing device, including devices suitable for cutting mushrooms, onions, and the like.

BRIEF DESCRIPTION OF THE DRAWINGS

FIG. 1 is a perspective view of a preferred food chopper.

FIG. 2 is an exploded view of a preferred food chopper.

DETAILED DESCRIPTION OF THE PREFERRED EMBODIMENT

Figure 3:
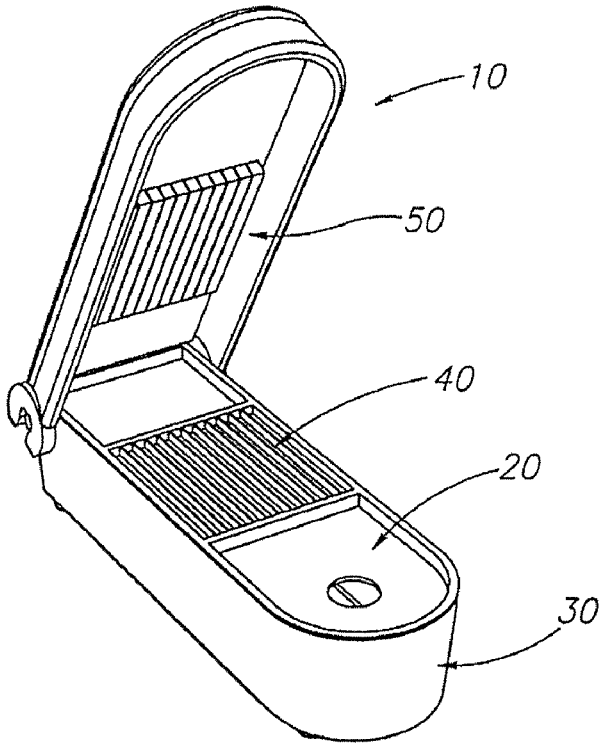
FIG. 3 is a perspective view of an alternate embodiment of a preferred food chopper.

A preferred food chopper is shown in FIG. 1, below. In the embodiment of FIG. 1, the food chopper includes three primary components, including a lid 10, a blade tray 20, and a food reservoir 30. The blade tray and the food reservoir are pivotally connected to one another, with the blade tray being removably mounted within an upper rim of the reservoir.

The lid is generally rectangular in shape, having squared corners at a first end that is pivotally connected to the reservoir and rounded corners at a second end opposite the first end. A downward-extending flange surrounds the peripheral edge of the lid, and is sized and shaped to snugly receive an outer surface of the reservoir within the flange when the lid is rotated downward against the reservoir.

The lid further includes a grid of projections 50 on the inner surface, extending downward in the same direction as the flange. The projections may take on any size or shape, as desired, and are ideally shaped to thoroughly push the food through the blades within the blade tray. As discussed further below, the blade tray includes a network of blades 40 configured at right angles and forming generally square openings. The projections on the lid are sized and located within the lid such that when the lid is closed a projection fits within each of the blade openings.

The food reservoir, best seen in the exploded view of FIG. 2, is formed in substantially the same shape as the lid when viewed from the top. Thus, in the preferred form, it has a generally rectangular shape with two rounded corners. The reservoir includes a bottom and four side walls to form an interior rectangular cubic cavity. The depth of the reservoir may vary, and is preferably sized to hold a typical expected volume of onions, mushrooms, or other food ingredients that may be used in cooking.

The reservoir includes a boss 64 at opposing sides of the squared ends of the top of the rectangular reservoir. The bosses are configured to be received within a pair of bores 66 at opposite sides of the squared ends of the lid, forming the pivotal connection between the lid and the reservoir. Accordingly, the lid is able to rotate about the pivotal connection from an open position that is preferably at least about 90 degrees with respect to the blade tray to a closed position resting adjacent and substantially flush with the blade tray.

Figure 4:
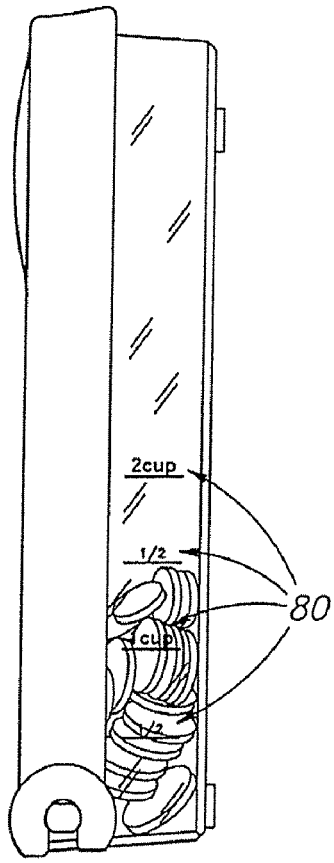
FIG. 4 is a side view of a preferred food chopper oriented on end.

In alternate embodiments of the invention, the reservoir also includes volumetric measurements on an inner or outer surface, as shown in FIG. 4. As discussed further below, the measurements enable the user to determine when he or she has chopped enough of the food ingredient, without the necessity of a further step of transferring the ingredient to an additional measuring cup.

In another alternate embodiment, the bores 66 on the lid are open adjacent the outer edge of the lid, as shown in FIG. 2, forming a C-shape. The C-shaped openings enable the lid to more readily be removed from the tray for cleaning.

The blade tray 20 is formed in the same shape as the lid and reservoir, such that in the preferred embodiment it comprises a rectangular shape with two rounded corners. A substantially square blade grid 40 is formed at a central location on the tray. Preferably, the tray is formed from plastic and the blade grid formed from stainless steel. The top edges of the blades within the grid are sharpened in order to slice through the foods that are being pushed through the blade grid from above.

At one end of the tray, in this case, the rounded end, a bore 62 is included to more easily enable the tray to be lifted from the reservoir and removed for cleaning and removal of the food within the reservoir.

The tray includes a flat base that transitions to a generally vertical peripheral wall, as best seen in FIG. 2. At the top of the wall, the tray includes a substantially horizontal peripheral flange. The wall and flange are sized and configured such that the wall is snugly received within the side walls of the reservoir, and the flange rests against a top rim of the reservoir. In this fashion, the flange enables the tray to rest securely atop the reservoir. Alternative arrangements are also possible, including for example an internal flange or shoulder within the reservoir. Likewise, the size and shape of the tray and other components may be varied, consistent with the invention.

Each of the lid, tray, and reservoir is preferably formed from plastic, except for the blades as noted above. In a preferred form, at least the reservoir is formed from clear plastic to enable the user to see the volume of food inside.

Figure 5:
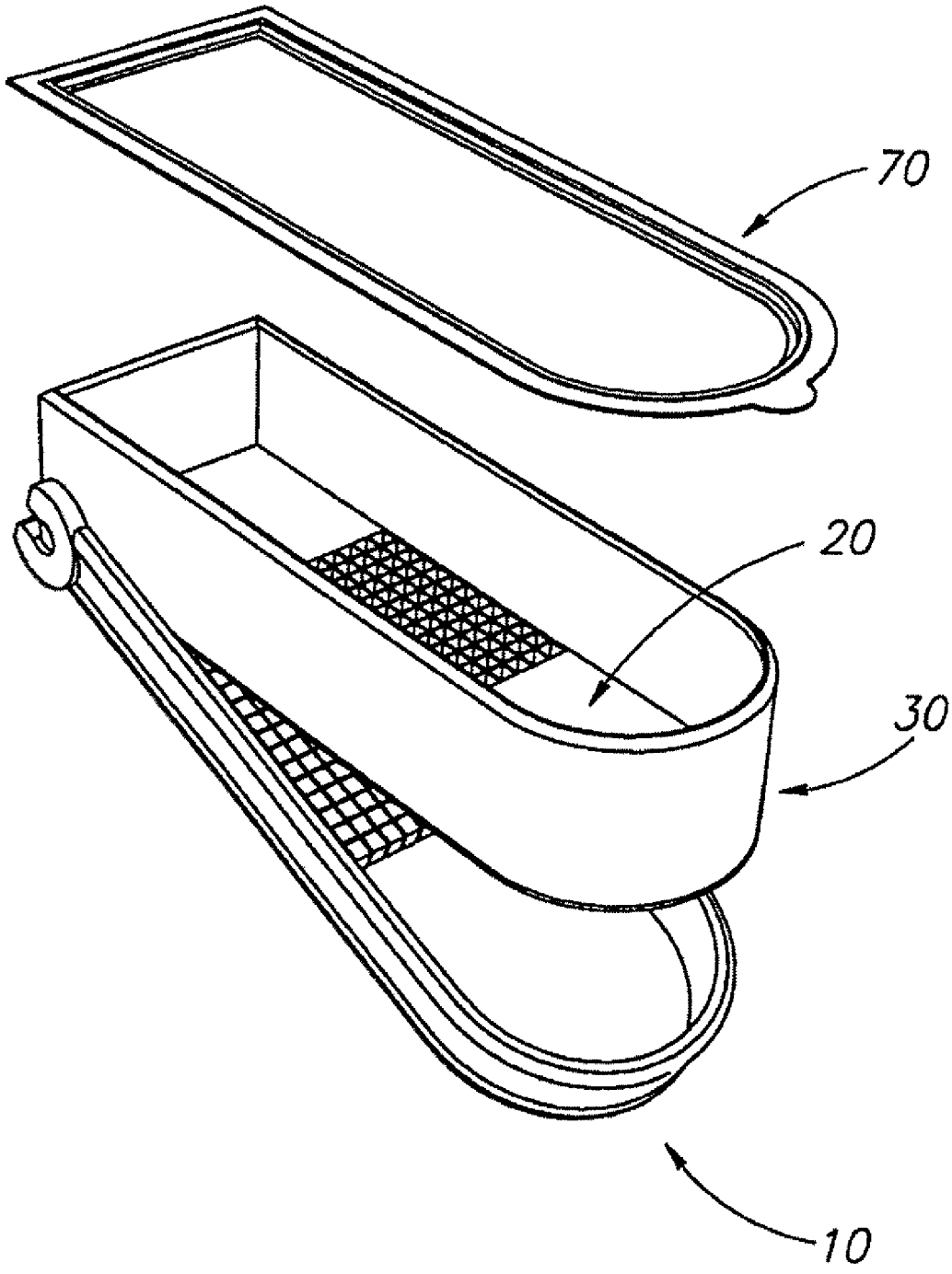
FIG. 5 is a partial exploded view of a preferred food chopper, oriented upside down.

The reservoir may optionally include non-skid feet attached to the bottom, as best seen in FIG. 4, formed from silicone or other suitable materials. In yet other embodiments, as best seen in FIGS. 2 and 5, the reservoir 30 may include a removable bottom section 70 that is preferably friction-fitted or snap-fitted into the reservoir 30. Thus, with the bottom section in place, food that is chopped with the device will be retained within the reservoir and can be readily carried to a pot or bowl. With the bottom removed, the chopper can be placed directly onto a plate, bowl, or other device to allow food to be chopped and dropped directly into the plate, bowl, or pan.

In some embodiments, a top surface of the lid includes a generally rounded convex shape adjacent the rounded end, as best seen in FIG. 2. This provides a better grip and more ergonomic surface for the user when chopping food within the device.

In use, the user places an onion (or other food item) atop the grid of blades while the lid is open. By pressing against the lid, causing pivotal and downward rotation of the lid, the grid of projections is pressed against the onion. In turn, the onion is pressed against the grid of blades, urging it through the blade openings and producing chopped onion sections having a cross-sectional shape that is the same as the blade openings. Once the lid approaches the blade grid, the projections press through the grid to clear any remaining food from the grid.

When the reservoir is full, or the chopping is completed, the tray is removed from the top of the reservoir. The chopped onion or other food may then be readily removed from the reservoir. The entire device can also be easily cleaned by separating the tray from the reservoir and, if desired, also removing the lid.

An alternate form of the food chopping device is shown in FIG. 3. In this form, the device includes the same primary components of a lid, tray, and reservoir. The primary difference is that the grid of blades comprises a plurality of elongated parallel blades, rather than two pluralities of blades arranged at right angles. The grid of projections extending from the lid is similarly configured as a series of adjacent parallel bars that will fit snugly through the grid of blades. In addition, the reservoir is somewhat deeper and the rectangular shape is somewhat shorter, with the length and width of the rectangle being closer in length to one another.

As shown in FIG. 4, the food chopping device may include measurement markings 80. In the preferred form, the measurement markings 80 are oriented vertically, so that the words are read properly with the device tipped up on end, or rotated 90 degrees. As food is chopped with the device, it will form a mound shape, making it difficult to tell with certainty the amount of food that has been chopped, even if there are measurement markings oriented horizontally. This is especially true for devices that have a base of a width or length that is substantially greater than the height. In order to determine the amount of food that has been chopped, the device is rotated 90 degrees, allowing the food to settle to the hinged end. The device may be shaken gently to allow the food to settle and form a substantially horizontal top. At that point, the user can determine the amount of chopped onions or other food ingredients by looking at the measurement markings associated with the top of the ingredient level through the clear plastic food reservoir. Ideally, the size of the reservoir is sufficient to accommodate a typically expected volume of food. In the example shown in FIG. 4, there are markings in half-cup increments up to the 2-cup level, with the reservoir itself exceeding 2 cups in volume.

As shown in FIG. 4, the volumetric markings 80 are placed on a sidewall of the reservoir. In alternate embodiments, the markings may be placed on the bottom 70, the lid 10, or in other locations that are visible and enable a determination of the volume of articles within the device.

This alternate embodiment is particularly well suited for use in slicing mushrooms or other foods intended to be sliced rather than chopped into smaller bits. The device is used in the same manner, by placing a mushroom or other food item atop the grid of blades and rotating the lid toward the tray, urging the food through the grid of blades.

While the preferred embodiment of the invention has been illustrated and described, as noted above, many changes can be made without departing from the spirit and scope of the invention.

The embodiments of the invention in which an exclusive property or privilege is claimed are defined as follows:

1. A food processing device, comprising:

a reservoir having upwardly extending sidewalls, the sidewalls having a top end and a bottom end, the reservoir having a top end and a bottom end;

a tray having a peripheral tray flange supported by the top end of the sidewalls of the reservoir, the tray having an interior region fitting within the sidewalls of the reservoir, the tray having a plurality of blades wherein the plurality of blades include a sharpened upper edge, a first surface devoid of blades on a first side of the plurality of blades and spanning opposing sidewalls of the reservoir, and a second surface devoid of blades on a second side of the plurality of blades and spanning opposing sidewalls of the reservoir, the first surface and the second surface each being within the interior region, each of the first surface and the second surface being offset below the sharpened upper edges of the plurality of blades and below an upper surface of the peripheral tray flange; and a lid pivotally attached to the reservoir for movement between a first position adjacent the tray and a second position relatively distant from the tray, the lid having a plurality of projections sized and configured to be received between the plurality of blades when the lid is adjacent the tray, and further wherein the second surface is adjacent a location of pivotal attachment of the lid to the reservoir, the lid further comprising a peripheral lid flange configured to receive and extend below the top end of the sidewalls of the reservoir and the peripheral tray flange when the lid is in the first position;

whereby when the lid is pivoted to the first position an open space is defined between an interior surface of the lid and each of the first surface and the second surface.

2. The device of claim 1, further comprising a bore formed in the first surface, the bore extending fully through the tray.

3. The device of claim 2, wherein the plurality of blades further comprises a first plurality of parallel blades and a second plurality of parallel blades, the second plurality of parallel blades being generally orthogonal to the first plurality of parallel blades to define a plurality of substantially square openings, and further wherein each of the projections among the plurality of projections is configured to fit within one of the plurality of substantially square openings.

4. The device of claim 2, wherein the first surface is substantially planar.

5. The device of claim 4, wherein the lid is removably attached to the reservoir.

6. The device of claim 5, further comprising a reservoir bottom removably secured to the bottom end of the reservoir sidewalls.

7. The device of claim 6, wherein the tray is removably secured to the reservoir.

8. The device of claim 7, wherein the reservoir is substantially transparent.

9. The device of claim 8, wherein the reservoir further comprises one or more volumetric indicators.

10. The device of claim 9, wherein the peripheral tray flange is removably mounted-to the top end of the reservoir sidewalls.

11. The device of claim 10, wherein the one or more volumetric indicators are arranged on the device to indicate a volume of a portion of the reservoir between a first one of the upwardly extending sidewalls and a top surface of a mound of items within the reservoir when the device is oriented such that the bottom of the mound is resting on the first one of the upwardly extending sidewalls of the reservoir.

* * * * *